US009528376B2

(12) United States Patent
Race et al.

(10) Patent No.: US 9,528,376 B2
(45) Date of Patent: Dec. 27, 2016

(54) COMPRESSOR FAIRING SEGMENT

(75) Inventors: Nathan Stafford Race, Simpsonville, SC (US); Brian Denver Potter, Greer, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 1030 days.

(21) Appl. No.: 13/613,043

(22) Filed: Sep. 13, 2012

(65) Prior Publication Data

US 2014/0069101 A1 Mar. 13, 2014

(51) Int. Cl.

| | |
|---|---|
| ***F01D 5/06*** | (2006.01) |
| ***F01D 5/14*** | (2006.01) |
| ***F01D 5/30*** | (2006.01) |
| ***F04D 29/52*** | (2006.01) |
| ***F04D 29/56*** | (2006.01) |

(52) U.S. Cl.

CPC ..... *F01D 5/06* (2013.01); *F01D 5/143* (2013.01); *F01D 5/3007* (2013.01); *F04D 29/522* (2013.01); *F04D 29/563* (2013.01)

(58) Field of Classification Search

CPC ..... F01D 11/001; F01D 11/02; F01D 5/06; F01D 5/066; F01D 5/3007; F01D 5/3015; F01D 5/3069; F01D 5/32; F01D 5/323; F01D 5/326; F01D 5/143; F04D 29/083; F04D 29/122; F04D 29/321; F04D 29/322; F04D 29/522; F04D 29/541; F04D 29/563

USPC ..... 416/198 A, 200 A, 201 R; 415/173.7, 415/170.1

See application file for complete search history.

(56) References Cited

U.S. PATENT DOCUMENTS

| | | | | | |
|---|---|---|---|---|---|
| 941,389 | A | * | 11/1909 | Snyder | F01D 5/06 416/198 R |
| 943,480 | A | * | 12/1909 | Snyder | F01D 5/06 416/198 R |
| 2,656,147 | A | * | 10/1953 | Brownhill | F01D 5/084 416/193 A |
| 2,662,685 | A | * | 12/1953 | Blanc | F01D 5/066 416/198 R |
| 2,773,667 | A | * | 12/1956 | Wheatley | F01D 11/001 415/136 |
| 2,786,625 | A | * | 3/1957 | Kent | F01D 5/06 416/201 R |
| 2,869,820 | A | * | 1/1959 | Marchant | F01D 5/06 416/201 R |
| 2,892,583 | A | * | 6/1959 | Clarke | F01D 5/06 29/889.21 |
| 3,035,759 | A | * | 5/1962 | Paulson | F01D 5/06 415/111 |
| 3,094,309 | A | * | 6/1963 | Hull, Jr. | F01D 5/06 415/173.7 |

(Continued)

FOREIGN PATENT DOCUMENTS

| | | |
|---|---|---|
| EP | 0718469 | 6/1996 |
| EP | 1004750 | 5/2000 |
| EP | 1582700 A2 | 5/2005 |

*Primary Examiner* — Gregory Anderson
*Assistant Examiner* — Wayne A Lambert
(74) *Attorney, Agent, or Firm* — Dority & Manning, PA

(57) ABSTRACT

A compressor fairing segment includes a body having an upstream surface, a downstream surface, and opposing side surfaces between the upstream and downstream surfaces. A first detent on the upstream surface is shaped to conform to a first complementary fitting inside a compressor. A second detent on the downstream surface shaped to conform to a second complementary fitting inside the compressor.

18 Claims, 8 Drawing Sheets

(56) References Cited

U.S. PATENT DOCUMENTS 3,295,825 A * 1/1967 Hall, Jr. ..... F01D 5/06 415/173.7
3,754,766 A * 8/1973 Asplund ..... F16J 15/0887 277/644
3,867,063 A * 2/1975 Bulavin ..... F01D 9/042 415/138
4,005,946 A * 2/1977 Brown ..... F01D 11/18 415/136
4,127,359 A * 11/1978 Stephan ..... F01D 11/005 416/198 A
4,311,432 A * 1/1982 Kildea ..... F01D 11/08 415/134
4,432,697 A * 2/1984 Miura ..... F01D 5/06 415/199.5
4,551,064 A * 11/1985 Pask ..... F01D 11/08 415/115
4,553,901 A * 11/1985 Laurello ..... F01D 11/24 415/116
5,080,556 A * 1/1992 Carreno ..... F16J 15/442 277/590
5,161,949 A * 11/1992 Brioude ..... F01D 5/22 416/193 A
5,211,407 A 5/1993 Glynn et al.
5,370,501 A * 12/1994 Udall ..... F01D 5/30 416/216
5,562,404 A 10/1996 Koff et al.
5,738,490 A * 4/1998 Pizzi ..... F01D 11/005 415/139
5,842,831 A * 12/1998 Galke ..... F01D 5/08 416/198 A
5,860,789 A * 1/1999 Sekihara ..... F01D 5/066 416/201 R
5,950,308 A 9/1999 Koff et al.
6,139,264 A 10/2000 Schilling
6,315,519 B1 * 11/2001 Bagepalli ..... F01D 11/08 415/135
6,692,228 B2 * 2/2004 Turnquist ..... F01D 5/08 29/889
6,808,363 B2 * 10/2004 Darkins, Jr. ..... F01D 11/005 277/630
6,811,375 B2 * 11/2004 Brisson ..... F01D 11/001 415/173.7
6,821,085 B2 * 11/2004 Darkins, Jr. ..... F01D 11/08 415/116
6,893,214 B2 * 5/2005 Alford ..... F01D 9/04 415/138
7,118,335 B2 10/2006 Vacarezz et al.
7,278,820 B2 * 10/2007 Keller ..... F01D 11/08 415/173.1
7,320,574 B2 * 1/2008 Greim ..... F01D 5/225 415/170.1
7,494,317 B2 * 2/2009 Keller ..... F01D 11/025 415/135
7,510,369 B2 3/2009 Lytle
7,588,415 B2 9/2009 Giaiamo et al.
7,628,579 B2 12/2009 Giaiamo et al.
7,665,959 B2 2/2010 Giaimo et al.
7,690,889 B2 4/2010 Giamo et al.
7,726,936 B2 * 6/2010 Keller ..... F01D 11/12 415/173.4
7,753,647 B2 7/2010 Giamo et al.
7,854,586 B2 12/2010 Major et al.
7,901,178 B2 3/2011 Giaimo et al.
8,016,297 B2 9/2011 Heinemann et al.
8,092,157 B2 1/2012 McCaffrey
8,105,024 B2 1/2012 Khanin et al.
2003/0082049 A1 * 5/2003 Brisson ..... F01D 11/003 415/173.7
2006/0045747 A1 3/2006 Martin et al.
2006/0228210 A1 * 10/2006 Bachofner ..... F01D 5/06 415/174.4
2011/0052387 A1 * 3/2011 Kneeland ..... F01D 5/141 415/208.1
2011/0255977 A1 * 10/2011 Bhagavatheeswaran F01D 5/066 416/198 A

* cited by examiner

COMPRESSOR FAIRING SEGMENT

FIELD OF THE INVENTION

The present invention generally involves a fairing segment. In particular embodiments, a plurality of the fairing segments may be incorporated into a compressor.

BACKGROUND OF THE INVENTION

Compressors are widely used in industrial and commercial operations. For example, a typical commercial gas turbine used to generate electrical power includes an inlet section, a compressor section downstream from the inlet section, a combustion section downstream from the compressor section, a turbine section downstream from the combustion section, and an exhaust section downstream from the turbine section. The inlet section purifies and otherwise conditions a working fluid (e.g., air) that flows into the compressor section. The compressor section produces a compressed working fluid that flows to the combustion section where it mixes with fuel before combusting to produce combustion gases having a high temperature and pressure. The combustion gases flow through the turbine section to produce work, and the exhaust section purifies and otherwise conditions the combustion gases prior to further use and/or discharge to the environment.

FIG. 1 provides a perspective view of an exemplary prior art compressor 10, and FIG. 2 provides a side cross-section view of the exemplary compressor 10 shown in FIG. 1. As shown in FIGS. 1 and 2, a casing 12 generally surrounds the compressor 10 to contain a working fluid (e.g., air), and a portion of the casing 12 has been removed in FIG. 1 to expose the components inside the compressor 10. Alternating stages of rotating blades 14 and stator vanes 16 inside the casing 12 progressively impart kinetic energy to the working fluid to produce a compressed working fluid at a highly energized state. Each rotating blade 14 may be circumferentially arranged around a rotor wheel 18 to extend radially outward toward the casing 12. Conversely, each stator vane 16 may be circumferentially arranged around the casing 12 to extend radially inward toward a spacer wheel 20 that separates adjacent stages of rotating blades 14.

Compressed working fluid that leaks around or bypasses the stator vanes 16 reduces the efficiency of the compressor 10. As a result, some compressors may include inner shroud segments or fairing segments to reduce the amount of compressed working fluid that flows between the stator vanes 16 and the spacer wheel 20. For example, as shown most clearly in FIG. 2, the spacer wheels 20 radially inward from the stator vanes 16 may include circumferential dovetail slots 22 adapted to receive T-shaped fairing segments 24. The circumferential dovetail slots 22 radially restrain the T-shaped fairing segments 24, and the T-shaped fairing segments 24 include a surface 26 that generally conforms to an inner tip 28 of the stator vanes 16 to reduce leakage between the stator vanes 16 and the spacer wheels 20. Although the T-shaped fairing segments 24 are effective at reducing leakage between the stator vanes 16 and the spacer wheels 20, the circumferential dovetail slots 22 in the spacer wheels 20 may reduce the high cycle fatigue limit of the spacer wheels 20. As a result, an improved fairing segment that does not require slots in the spacer wheels would be useful.

BRIEF DESCRIPTION OF THE INVENTION

Aspects and advantages of the invention are set forth below in the following description, or may be obvious from the description, or may be learned through practice of the invention.

One embodiment of the present invention is a compressor fairing segment that includes a body having an upstream surface, a downstream surface, and opposing side surfaces between the upstream and downstream surfaces. A first detent on the upstream surface is shaped to conform to a first complementary fitting inside a compressor. A second detent on the downstream surface shaped to conform to a second complementary fitting inside the compressor.

Another embodiment of the present invention is a compressor fairing segment that includes a body having an upstream surface, a downstream surface, and opposing side surfaces between the upstream and downstream surfaces. The compressor fairing segment further includes first means for retaining the upstream surface against at least one of a first rotor wheel or a first rotating blade inside a compressor and second means for retaining the downstream surface against at least one of a second rotor wheel or a second rotating blade inside the compressor.

The present invention may also include a gas turbine having a compressor section with a first rotor wheel, a first stage of rotating blades circumferentially arranged around the first rotor wheel, a second rotor wheel downstream from the first rotor wheel, and a second stage of rotating blades circumferentially arranged around the second rotor wheel. A plurality of fairing segments extend between the first rotor wheel and the second rotor wheel. Each fairing segment includes a first detent shaped to conform to a first complementary fitting on at least one of the first rotor wheel or a first rotating blade in the first stage of rotating blades and a second detent shaped to conform to a second complementary fitting on at least one of the second rotor wheel or a second rotating blade in the second stage of rotating blades. A combustion section is downstream from the compressor section, and a turbine section is downstream from the combustion section.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
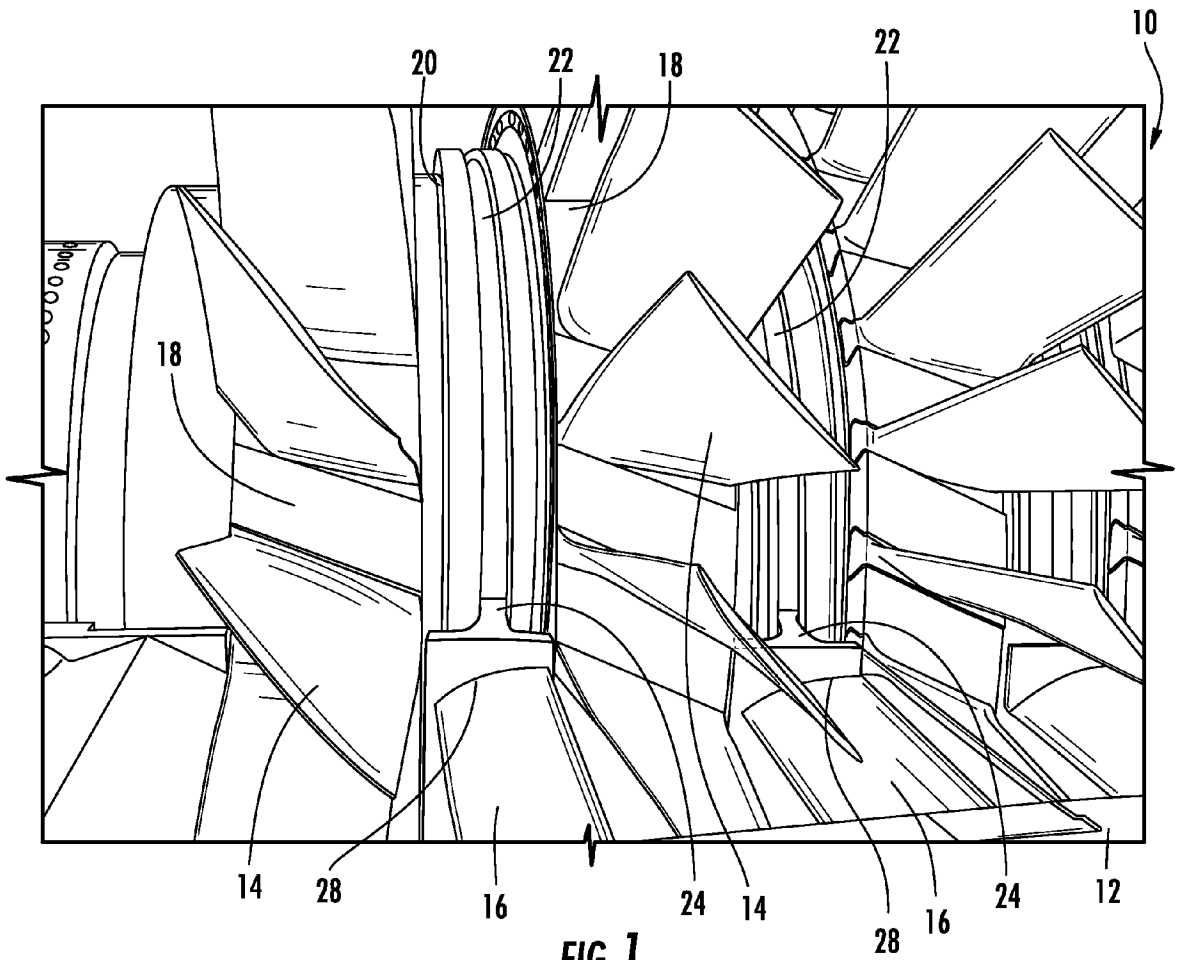
FIG. 1 (PRIOR ART)
FIG. 1 is a perspective view of an exemplary prior art compressor with the casing removed.
Figure 2:
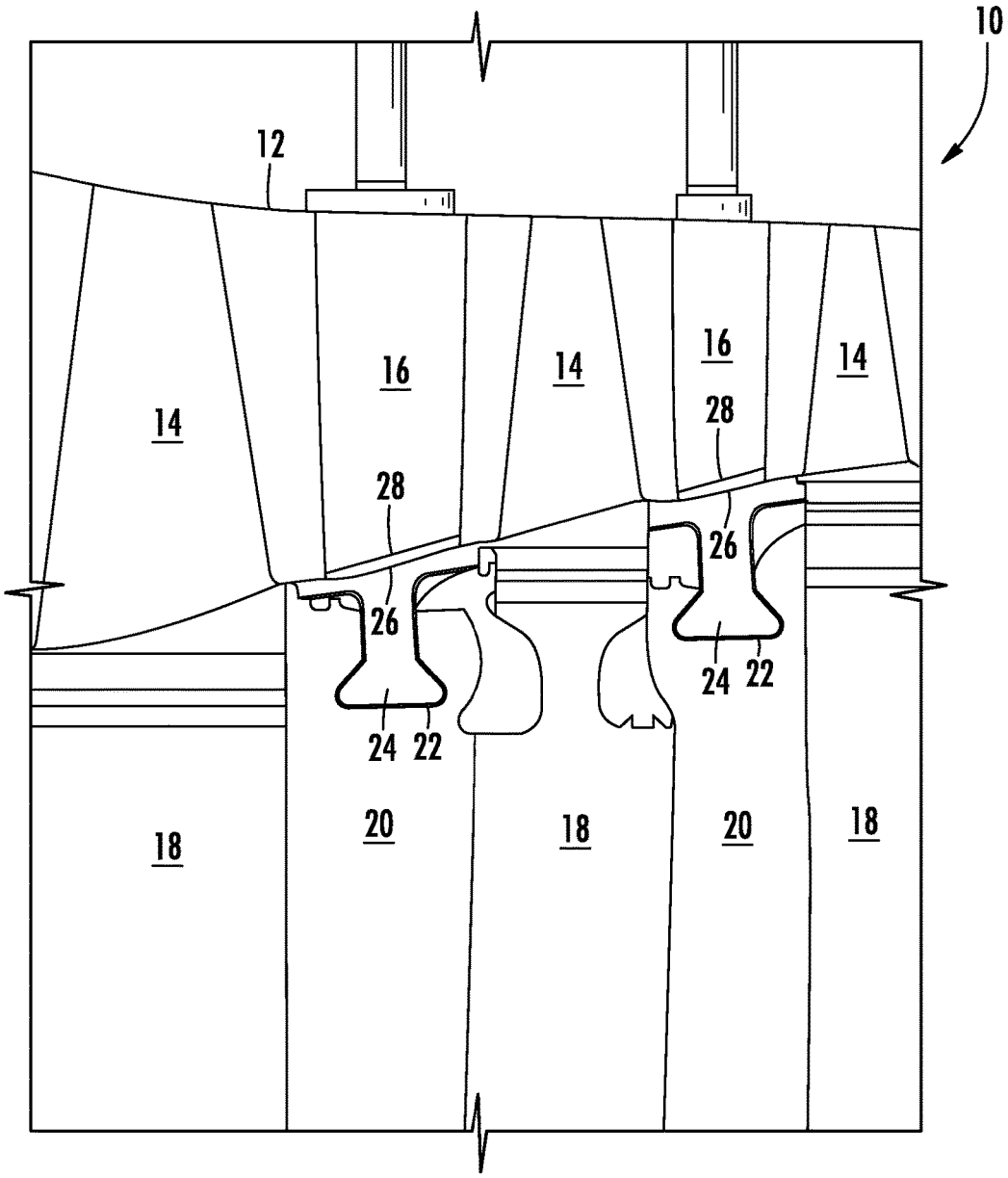
FIG. 2 (PRIOR ART)
FIG. 2 is a side cross-section view of the exemplary compressor shown in FIG. 1.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. In addition, the terms "upstream" and "downstream" refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include one or more fairing segments that may be incorporated into a compressor to enhance the efficiency of the compressor. The compressor generally includes alternating stages of rotating blades and stator vanes, as is known in the art. Each fairing segment generally extends between adjacent stages of rotating blades and includes various means for holding the fairing segment in place. In particular embodiments, each fairing segment may include a surface that conforms to an inner tip of the stator vanes, and a plurality of the fairing segments may be circumferentially arranged around a rotor wheel between adjacent stages of rotating blades to reduce the amount working fluid that may bypass a stage of stator vanes. Although exemplary embodiments of the present invention will be described generally in the context of a compressor incorporated into a gas turbine for purposes of illustration, one of ordinary skill in the art will readily appreciate that embodiments of the present invention may include and/or be incorporated into any compressor unless specifically recited in the claims.

Figure 3:
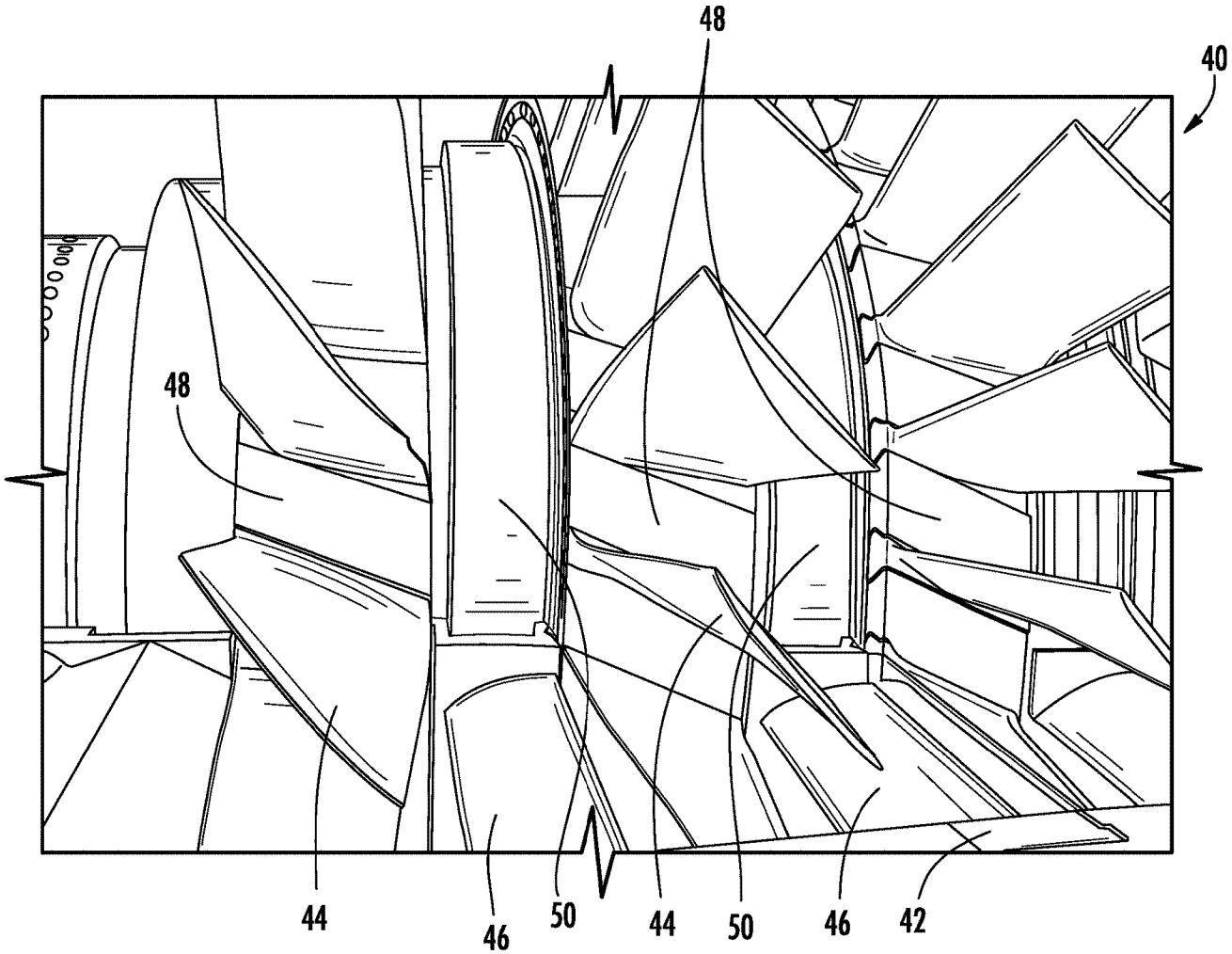
FIG. 3 is a perspective view of an exemplary compressor with the casing removed according to one embodiment of the present invention.
Figure 4:
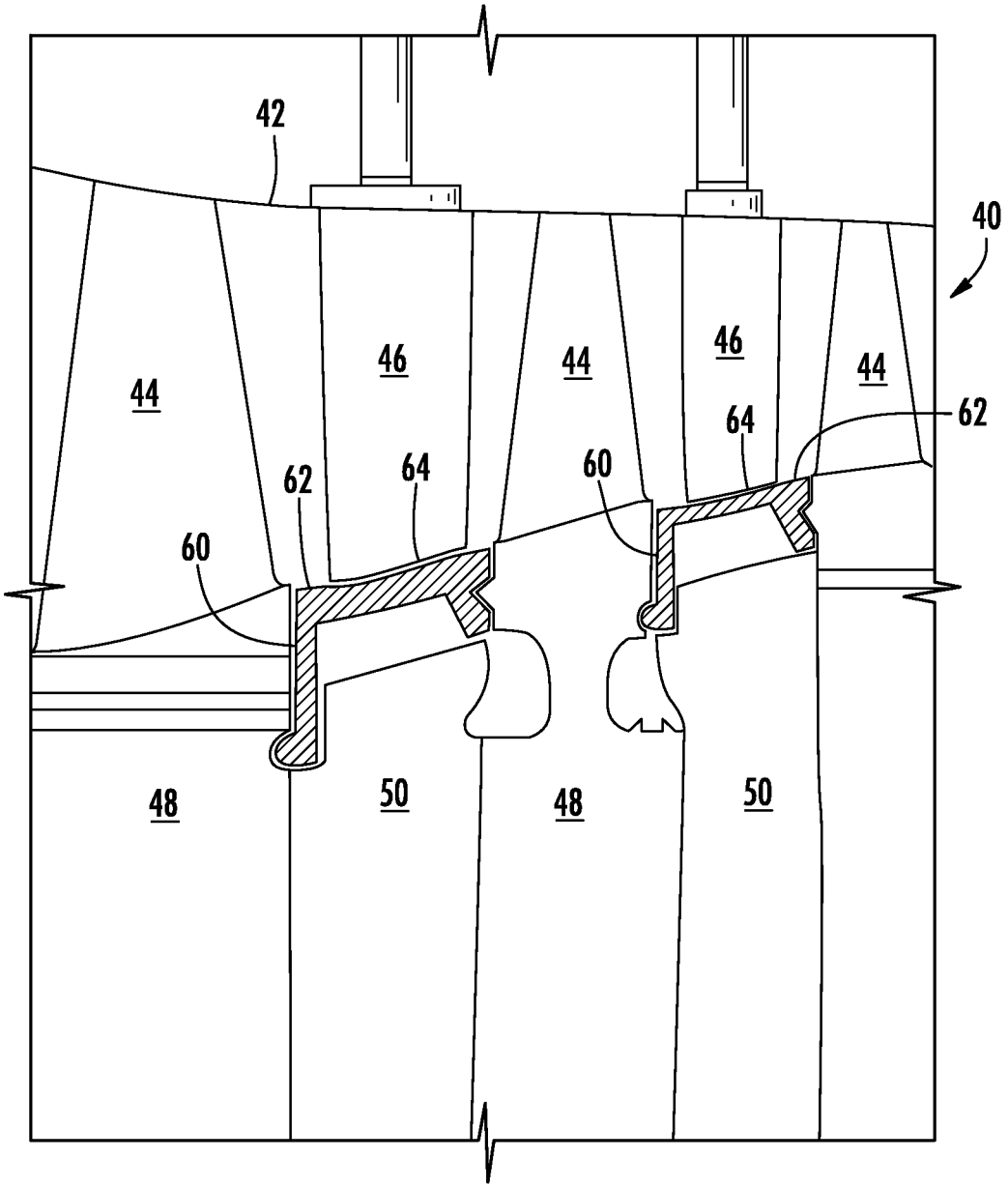
FIG. 4 is a side cross-section view of the exemplary compressor shown in FIG. 3.

FIG. 3 provides a perspective view of an exemplary compressor 40 according to one embodiment of the present invention, and FIG. 4 provides a side cross-section view of the exemplary compressor 40 shown in FIG. 3. As shown in FIGS. 3 and 4, a casing 42 generally surrounds the compressor 40 to contain a working fluid (e.g., air), and a portion of the casing 42 has been removed in FIG. 3 to expose the components inside the compressor 40. Alternating stages of rotating blades 44 and stator vanes 46 inside the casing 42 progressively impart kinetic energy to the working fluid to produce a compressed working fluid at a highly energized state. Each rotating blade 44 may be circumferentially arranged around a rotor wheel 48 to extend radially outward toward the casing 42. Conversely, each stator vane 46 may be circumferentially arranged around the casing 42 to extend radially inward toward a rotor wheel 50 that separates adjacent stages of rotating blades 44. The rotor wheels 48, 50 may be sequentially connected together to collectively form a rotor along an axial centerline of the compressor 40.

As shown in FIGS. 3 and 4, a plurality of fairing segments 60 may extend between rotor wheels 48 of adjacent stages of rotating blades 44. Each fairing segment 60 may include various means for holding the fairing segment 60 in place between adjacent stages of rotating blades 44. In addition, as shown most clearly in FIG. 4, the fairing segments 60 may be circumferentially arranged around the rotor wheels 50 that separate adjacent stages of rotating blades 44, and each fairing segment 60 may include or define a surface 62 that conforms to an inner tip 64 of the stator vanes 46. In this manner, the fairing segments 60 may reduce the amount of compressed working fluid that bypasses the stator vanes 46 between the inner tips 64 of the stator vanes 46 and the rotor wheel 50.

Figure 5:
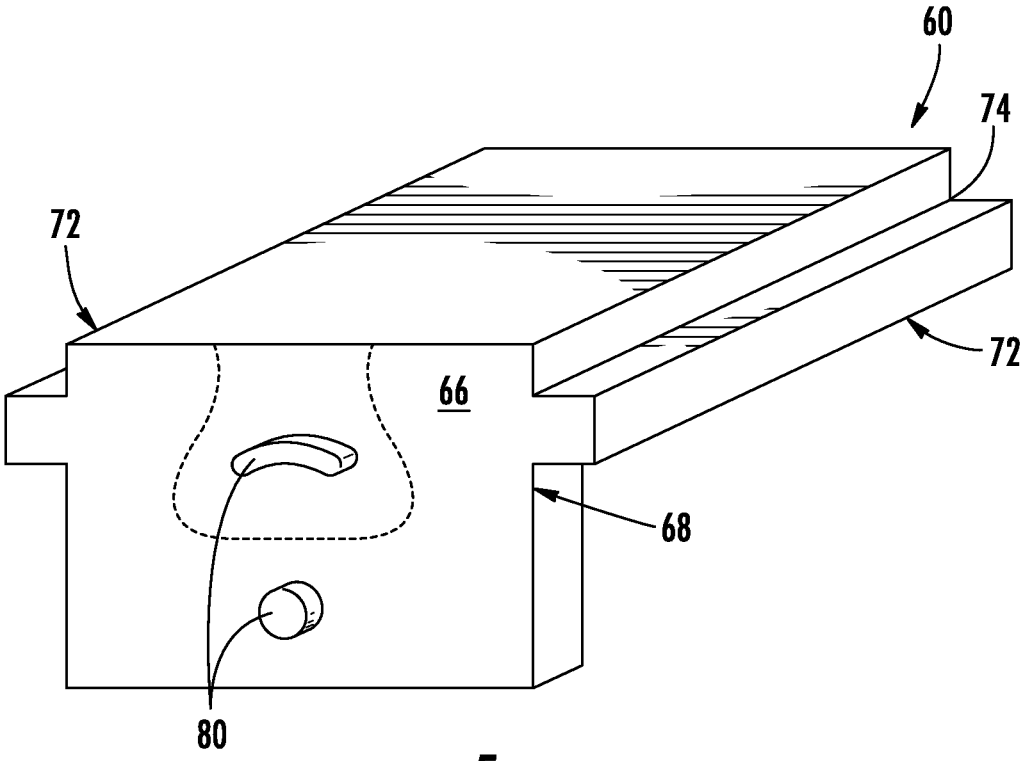
FIG. 5 is a downstream perspective view of a fairing segment shown in FIGS. 3 and 4 according to one embodiment of the present invention.
Figure 6:
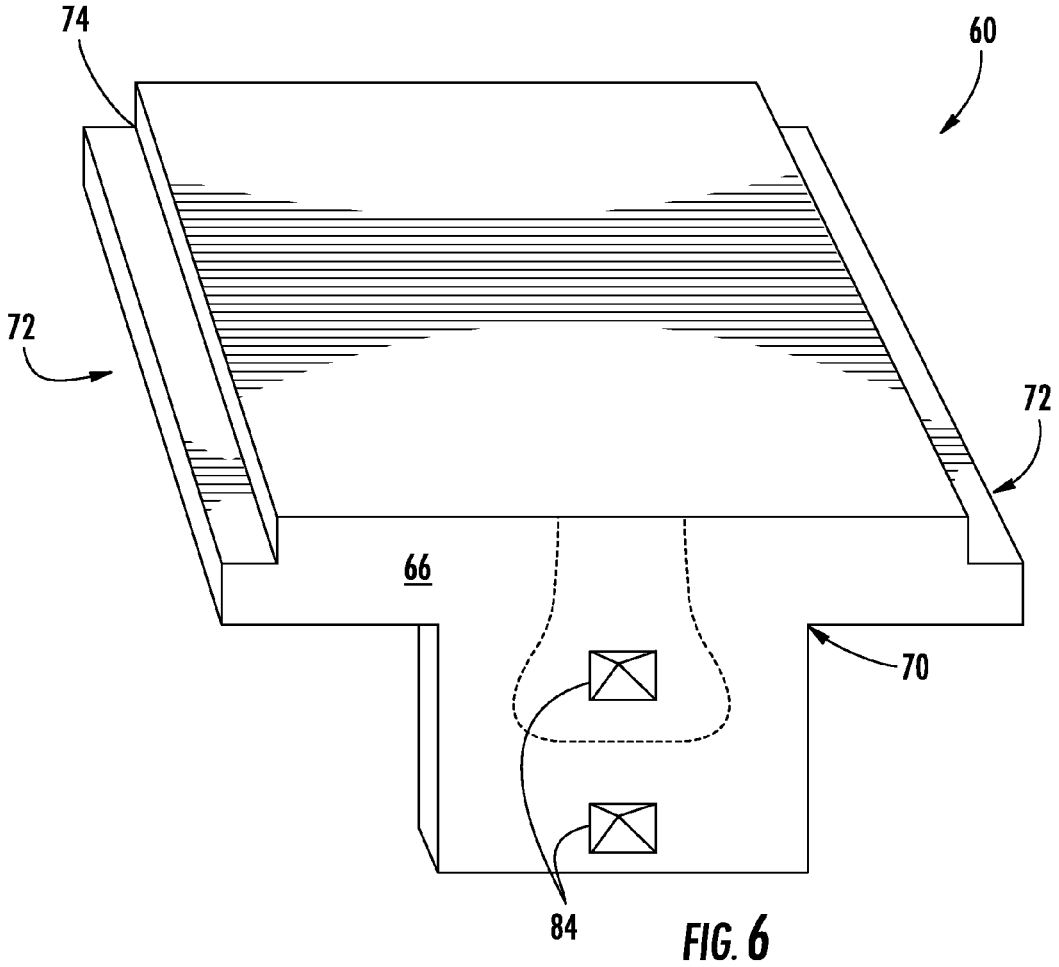
FIG. 6 is an upstream perspective view of the fairing segment shown in FIG. 5.

FIGS. 5 and 6 provide downstream and upstream perspective views, respectively, of the fairing segment 60 shown in FIGS. 3 and 4 according to one embodiment of the present invention. As shown in FIGS. 5 and 6, the fairing segment 60 generally includes a body 66 having an upstream surface 68, a downstream surface 70, and opposing side surfaces 72 between the upstream and downstream surfaces 68, 70. The upstream surface 68 is generally narrower than the downstream surface 70 to conform to the generally increasing diameter of the compressor 40 in the downstream direction, although such is not a limitation of the present invention unless specifically recited in the claims. In addition, the opposing side surfaces 72 may further include a groove, ledge, rabbet 74, or similar structure for providing a smooth, complementary fitting between adjacent fairing segments 60.

Figure 7:
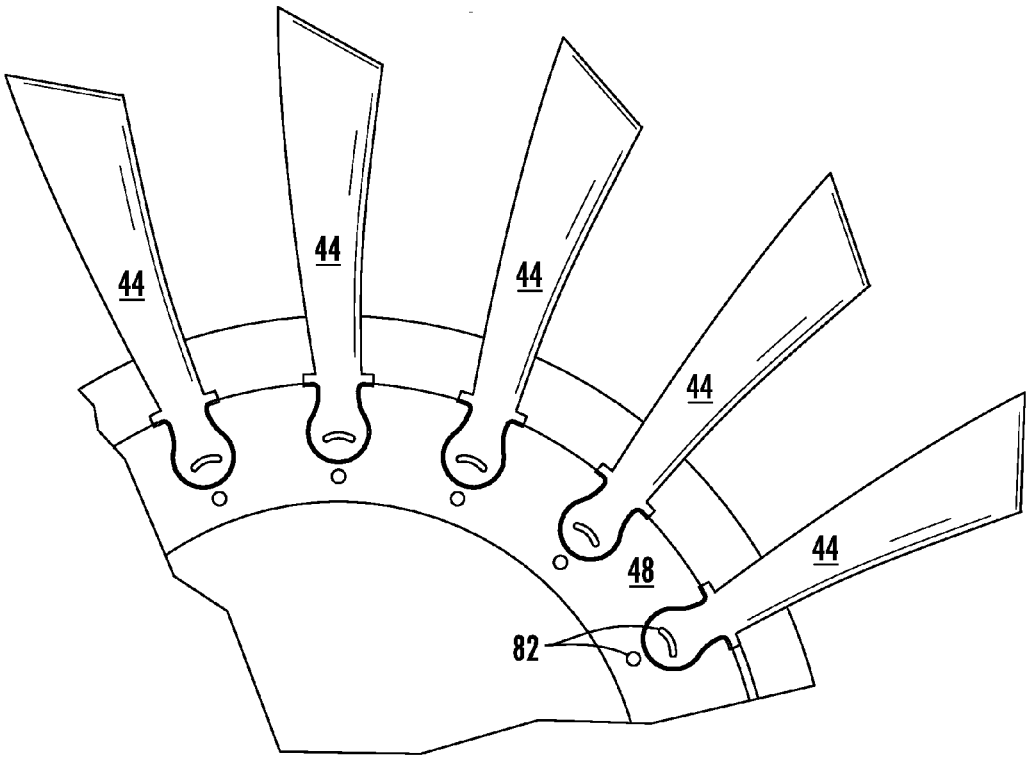
FIG. 7 is an upstream perspective view of a rotor wheel shown in FIGS. 3 and 4.
Figure 8:
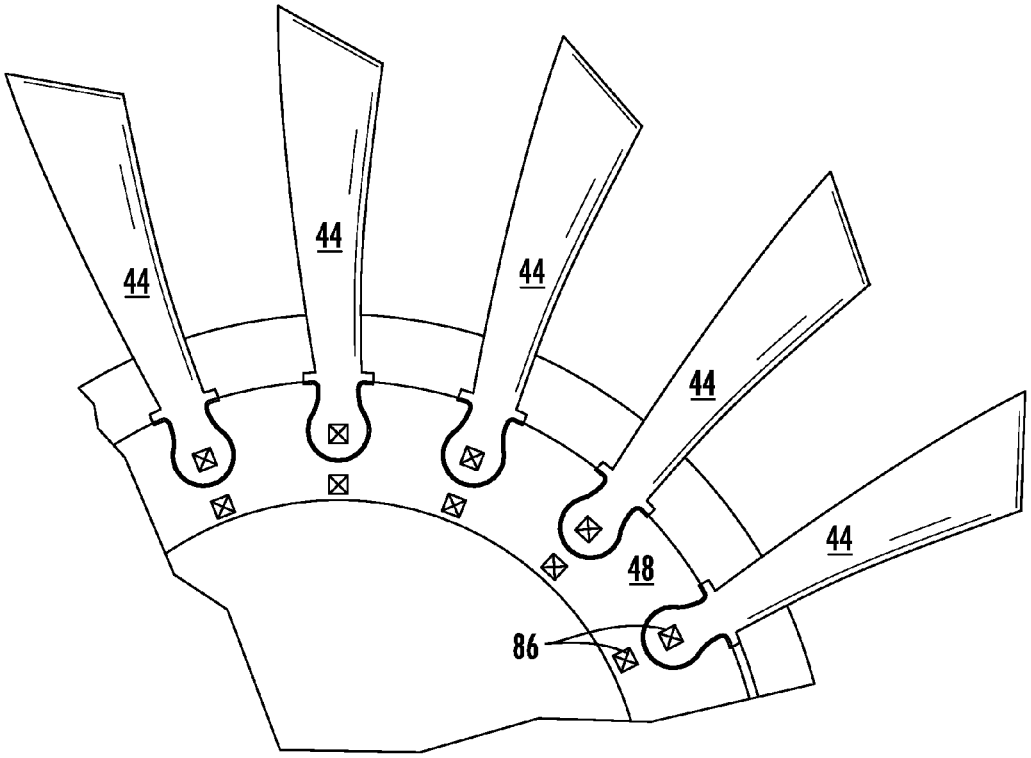
FIG. 8 is a downstream perspective view of the rotor wheel shown in FIG. 7.

FIG. 7 provides an upstream perspective view of the rotor wheel 48 immediately upstream from the fairing segment 60, and FIG. 8 provides a downstream perspective view of the rotor wheel 48 immediately downstream from the fairing segment 60. As shown in FIGS. 5-8, the fairing segment 60 may further include first means for retaining the upstream surface 68 against the adjacent rotating blade 44 and/or rotor wheel 48 (shown in FIG. 7) and second means for retaining the downstream surface 70 against the adjacent rotating blade 44 and/or rotor wheel 48 (shown in FIG. 8). The function of the first and second means is to prevent inadvertent circumferential and/or radial movement of the upstream and/or downstream surfaces 68, 70 of the fairing segment 60 with respect to the respective adjacent rotating blade 44 and/or rotor wheel 48 during operation, thereby retaining or holding the fairing segment 60 in place. The structure associated with the first and second means may include any device, fitting, or mechanism known in the art for holding or retaining one component against another component. For example, the structure associated with the first and second means may include any combination of adhesive, bolts, screws, hasps, clamps, detents, and/or complementary fittings in one or more of the rotating blades 44, rotor wheels 48, upstream surface 68, and/or downstream surface 70. In the particular embodiment shown in FIGS. 5 and 7, for example, the structure associated with the first means may include one or more detents or projections 80 on the upstream surface 68 (shown in FIG. 5) shaped to conform to complementary fittings or recesses 82 in the adjacent rotating blade 44 and/or rotor wheel 48 (shown in FIG. 7). Similarly, referring to the particular embodiment shown in FIGS. 6 and 8, the structure associated with the second means may include one or more detents or recesses 84 on the downstream surface 70 (shown in FIG. 6) shaped to cover and/or conform to complementary fittings or projections 86 in the adjacent rotating blade 44 and/or rotor wheel 48 (shown in FIG. 8). One of ordinary skill in the art will readily appreciate from the teachings herein that multiple combinations of detents, fittings, projections, and recesses may provide suitable structure for the first and/or second means, and the present invention is not limited to any particular combination unless specifically recited in the claims.

Figure 9:
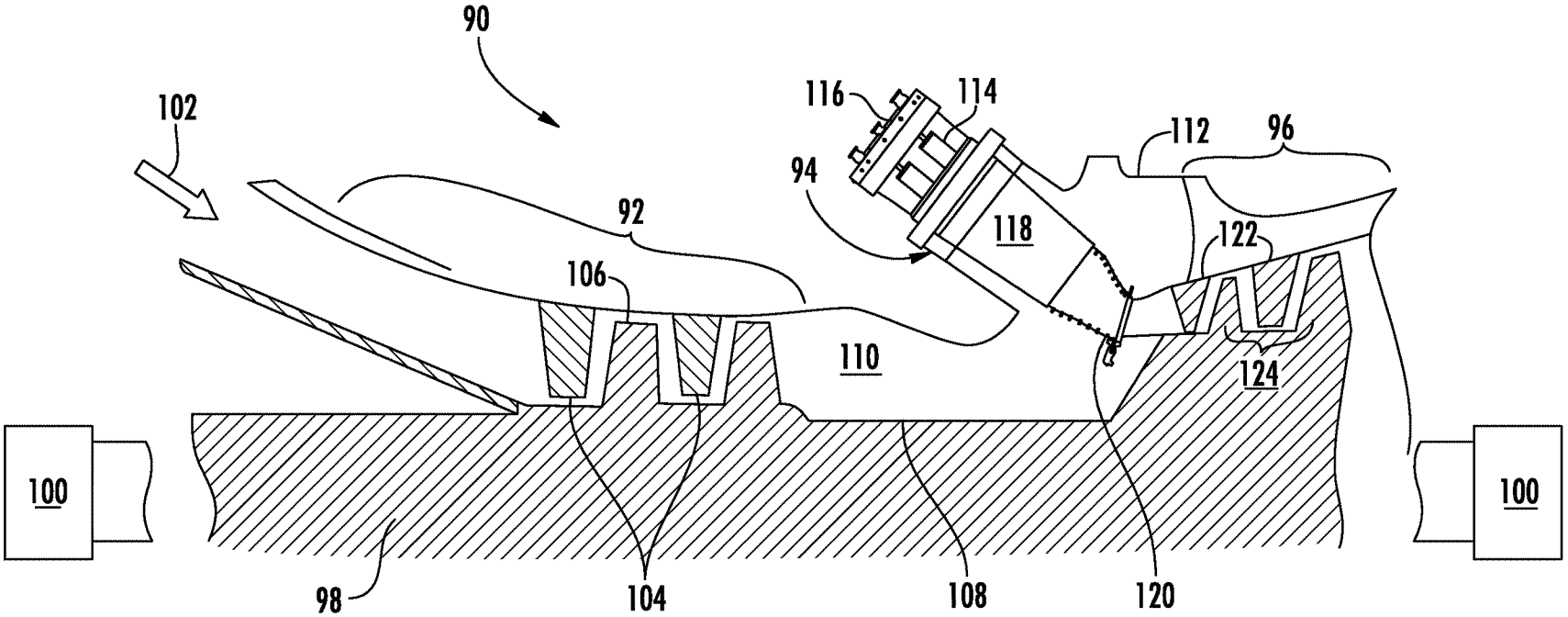
FIG. 9 is a cross section view of an exemplary gas turbine incorporating any embodiment of the present invention.

FIG. 9 provides a simplified cross-section view of an exemplary gas turbine 90 that may incorporate various embodiments of the present invention. As shown, the gas turbine 90 may generally include a compressor section 92 at the front, a combustion section 94 radially disposed around the middle, and a turbine section 96 at the rear. The compressor section 92 and the turbine section 96 may share a common rotor 98 connected to a generator 100 to produce electricity.

The compressor section 92 may include an axial flow compressor in which a working fluid 102, such as ambient air, enters the compressor and passes through alternating stages of stationary vanes 104 and rotating blades 106. A compressor casing 108 may contain the working fluid 102 as the stationary vanes 104 and rotating blades 106 accelerate and redirect the working fluid 102 to produce a continuous flow of compressed working fluid 102. The majority of the compressed working fluid 102 flows through a compressor discharge plenum 110 to the combustion section 94.

The combustion section 94 may include any type of combustor known in the art. For example, as shown in FIG. 9, a combustor casing 112 may circumferentially surround some or all of the combustion section 94 to contain the compressed working fluid 102 flowing from the compressor section 92. One or more fuel nozzles 114 may be radially arranged in an end cover 116 to supply fuel to a combustion chamber 118 downstream from the fuel nozzles 114. Possible fuels include, for example, one or more of blast furnace gas, coke oven gas, natural gas, vaporized liquefied natural gas (LNG), hydrogen, and propane. The compressed working fluid 102 may flow from the compressor discharge passage 110 along the outside of the combustion chamber 118 before reaching the end cover 116 and reversing direction to flow through the fuel nozzles 114 to mix with the fuel. The mixture of fuel and compressed working fluid 102 flows into the combustion chamber 118 where it ignites to generate combustion gases having a high temperature and pressure. A transition duct 120 circumferentially surrounds at least a portion of the combustion chamber 118, and the combustion gases flow through the transition duct 120 to the turbine section 96.

The turbine section 96 may include alternating stages of rotating buckets 124 and stationary nozzles 122. The transition duct 120 redirects and focuses the combustion gases onto the first stage of rotating buckets 124. As the combustion gases pass over the first stage of rotating buckets 124, the combustion gases expand, causing the rotating buckets 124 and rotor 98 to rotate. The combustion gases then flow to the next stage of stationary nozzles 122 which redirect the combustion gases to the next stage of rotating buckets 124, and the process repeats for the following stages.

One of ordinary skill in the art will readily appreciate from the teachings herein that the embodiment shown in FIGS. 3-8 may provide one or more benefits over existing T-fairings. For example, the first and second means prevent inadvertent circumferential and/or radial movement of the upstream and/or downstream surfaces 68, 70 of the fairing segment 60 with respect to the respective adjacent rotating blade 44 and/or rotor wheel 48 during operation. As a result, the embodiments described herein eliminate the need for the circumferential dovetail slots 22 previously included in the spacer wheels 20 to axially restrain the T-fairings 24. In addition, the circumferential arrangement of the fairing segments 60 around the rotor wheel 50 may allow the rabbets 74 in adjacent side surfaces 72 to form a shiplap seal between adjacent fairing segments 60 to further enhance efficiency in the compressor 40.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A compressor, comprising:

a first rotor wheel assembly including a first rotor wheel and a rotating blade having a mounting portion seated within a corresponding slot defined by the first rotor wheel, wherein a downstream surface of the mounting portion defines a recess therein;

a second rotor wheel assembly axially spaced downstream from the first rotor wheel assembly, the second rotor wheel assembly including a second rotor wheel and a rotating blade having a mounting portion seated within a corresponding slot defined by the second rotor wheel, wherein an upstream surface of the mounting portion defines a projection that extends outwardly therefrom towards the first rotor wheel; and a fairing segment that extends axially between a downstream surface of the first rotor wheel and an upstream surface of the second rotor wheel, the fairing segment having an upstream surface defining a first projection and a downstream surface defining a first recess;

wherein the first projection of the fairing segment is seated within the recess of the mounting portion of the rotating blade of the first rotor wheel assembly and the projection of the mounting portion of the rotating blade of the second rotor wheel assembly is seated within the first recess of the fairing segment, wherein the fairing segment mechanically link the mounting portion of the rotating blade of the first rotor wheel assembly to the mounting portion of the rotating blade of the second rotor wheel assembly.

2. The compressor as in claim 1, wherein the first projection of the fairing segment and the recess of the mounting portion of the rotor blade of the first rotor wheel assembly are arcuate shaped.

3. The compressor as in claim 1, wherein the upstream surface of the fairing segment further defines a second projection, wherein the second projection is seated within a complementary recess defined within the downstream surface of the first rotor wheel.

4. The compressor as in claim 3, wherein the second projection of the fairing segment and the recess defined within the downstream surface of the first rotor wheel are cylindrical shaped.

5. The compressor as in claim 1, wherein the first recess of the fairing segment and the projection of the mounting portion of the rotor blade coupled to the second rotor wheel assembly are complementarily shaped.

6. The compressor as in claim 1, wherein the downstream surface of the fairing segment further defines a second recess therein defined radially inward from the first recess, wherein the upstream surface of the second rotor wheel further defines a projection, wherein the projection of the upstream surface of the second rotor wheel is seated within the second recess.

7. The compressor as in claim 1, wherein the fairing segment includes circumferentially opposing side surfaces that extend between the upstream and downstream surfaces of the fairing segment, wherein each side surface is radially stepped.

8. The compressor as in claim 1, wherein an outer surface of the fairing segment defines a surface that conforms to an inner tip of a stator vane.

9. The compressor as in claim 1, wherein the upstream surface of the fairing segment is circumferentially wider than the downstream surface of the fairing segment.

10. A gas turbine, comprising:

a compressor, a combustor disposed downstream from the compressor and a turbine disposed downstream from the combustor, the compressor comprising:

a first rotor wheel assembly including a first rotor wheel and a rotating blade having a mounting portion seated within a corresponding slot defined by the first rotor wheel, wherein a downstream surface of the mounting portion defines a recess therein;

a second rotor wheel assembly axially spaced downstream from the first rotor wheel assembly, the second rotor wheel assembly including a second rotor wheel and a rotating blade having a mounting portion seated within a corresponding slot defined by the second rotor wheel, wherein an upstream surface of the mounting portion defines a projection that extends outwardly therefrom towards the first rotor wheel; and a fairing segment that extends axially between a downstream surface of the first rotor wheel and an upstream surface of the second rotor wheel, the fairing segment having an upstream surface defining a first projection and a downstream surface defining a first recess;

wherein the first projection of the fairing segment is seated within the recess of the mounting portion of the rotating blade of the first rotor wheel assembly and the projection of the mounting portion of the rotating blade of the second rotor wheel assembly is seated within the first recess of the fairing segment, wherein the fairing segment mechanically links the mounting portion of the rotating blade of the first rotor wheel assembly to the mounting portion of the rotating blade of the second rotor wheel assembly.

11. The gas turbine as in claim 10, wherein the first projection of the fairing segment and the recess of the mounting portion of the rotor blade of the first rotor wheel assembly are arcuate shaped.

12. The gas turbine as in claim 10, wherein the upstream surface of the fairing segment further defines a second projection, wherein the second projection is seated within a complementary recess defined within the downstream surface of the rotor wheel of the first rotor wheel assembly.

13. The gas turbine as in claim 12, wherein the second projection of the fairing segment and the recess defined within the downstream surface of the first rotor wheel are cylindrical shaped.

14. The gas turbine as in claim 10, wherein the first recess of the fairing segment and the projection of the mounting portion of the rotor blade coupled to the second rotor wheel assembly are complementarily shaped.

15. The gas turbine as in claim 10, wherein the downstream surface of the fairing segment further defines a second recess therein defined radially inward from the first recess, wherein the upstream surface of the second rotor wheel further defines a projection, wherein the projection of the upstream surface of the second rotor wheel is seated within the second recess.

16. The gas turbine as in claim 10, wherein the fairing segment includes circumferentially opposing side surfaces that extend between the upstream and downstream surfaces of the fairing segment, wherein each side surface is radially stepped.

17. The gas turbine as in claim 10, wherein an outer surface of the fairing segment defines a surface that conforms to an inner tip of a stator vane.

18. The gas turbine as in claim 10, wherein the upstream surface of the fairing segment is circumferentially wider than the downstream surface of the fairing segment.

* * * * *